US010443245B2

(12) United States Patent
Sprotofski et al.

(10) Patent No.: US 10,443,245 B2
(45) Date of Patent: Oct. 15, 2019

(54) LOUVER DRIVE SYSTEM

(71) Applicants: Helmut Sprotofski, Mahopac, NY (US); Ronald Kudla, Coopersburg, PA (US)

(72) Inventors: Helmut Sprotofski, Mahopac, NY (US); Ronald Kudla, Coopersburg, PA (US)

( * ) Notice: Subject to any disclaimer, the term of this patent is extended or adjusted under 35 U.S.C. 154(b) by 0 days.

(21) Appl. No.: 15/723,261

(22) Filed: Oct. 3, 2017

(65) Prior Publication Data

US 2018/0100310 A1 Apr. 12, 2018

Related U.S. Application Data

(60) Provisional application No. 62/403,234, filed on Oct. 3, 2016.

(51) Int. Cl.
*E06B 7/096* (2006.01)
*E04F 10/10* (2006.01)

(52) U.S. Cl.
CPC ..... *E04F 10/10* (2013.01); *E06B 7/096* (2013.01)

(58) Field of Classification Search
CPC ..... E04F 10/10; E06B 7/096
USPC ..... 49/74.1, 82.1
See application file for complete search history.

(56) References Cited

U.S. PATENT DOCUMENTS 2,272,722 A * 2/1942 Morin ..... E05F 17/00 49/300
5,052,150 A * 10/1991 Chen ..... E06B 7/084 454/224
5,713,156 A * 2/1998 Briggs, Sr. ..... E06B 9/26 49/74.1
6,145,251 A * 11/2000 Ricci ..... E06B 7/096 49/74.1
6,314,680 B1 * 11/2001 Buckwalter ..... E06B 7/096 49/74.1
7,328,533 B1 * 2/2008 Coleman ..... E06B 7/08 49/74.1
7,389,609 B2 * 6/2008 Yorgason ..... E06B 7/096 49/82.1
2005/0257429 A1 * 11/2005 Yorgason ..... E06B 7/096 49/82.1
2012/0085030 A1 * 4/2012 Marocco ..... E06B 7/096 49/82.1
2016/0032642 A1 * 2/2016 Rotchell ..... E06B 7/086 49/82.1

FOREIGN PATENT DOCUMENTS

WO WO-2005124087 A1 * 12/2005 ..... E06B 7/096

* cited by examiner

*Primary Examiner* — Jerry E Redman
(74) *Attorney, Agent, or Firm* — Patrick J. Halloran

(57) ABSTRACT

This disclosure describes louver drive systems and methods for using the same comprising a load bearing shell, an adjustable shell, louvers, and a louver device mechanism.

22 Claims, 7 Drawing Sheets

LOUVER DRIVE SYSTEM

RELATED APPLICATIONS

This application claims priority to U.S. Ser. No. 62/403,234 filed Oct. 3, 2016 which is incorporated herein in its entirety.

FIELD OF THE DISCLOSURE

This disclosure relates to the field of louver drive systems and methods for using the same.

BACKGROUND OF THE DISCLOSURE

This disclosure relates to the field of louver drive systems. Such systems may be used for protecting surfaces such as patios and the like from weather conditions or to improve the appearance and/or usability of the same. There is a need in the art for improved systems that are most flexible in use and autonomously interact with environmentally driven requirements, thus improving sustainability without compromising individual needs.

SUMMARY OF THE DISCLOSURE

Figure 1:
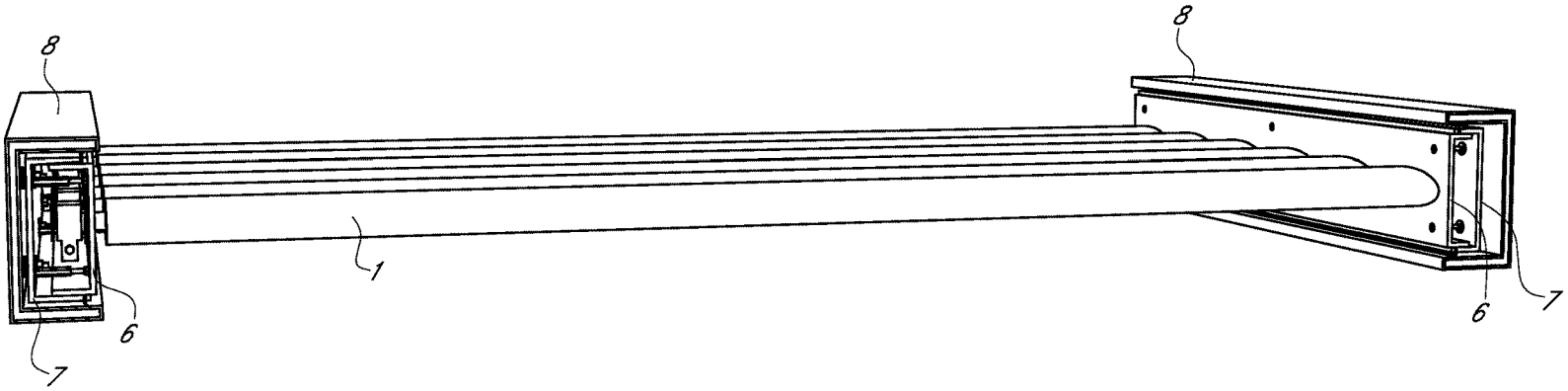
FIG. 1. Exemplary Louver Drive System.

This disclosure relates to louver drive systems and methods for using the same. In one embodiment, an exemplary louver drive system may comprise one or more load bearing shells (e.g., 7 in FIG. 1); one or more adjustable shells (e.g., 6 in FIG. 1); one or more louvers (e.g., 1 in FIG. 1); and one or more louver drive mechanisms (FIG. 2) which may each comprise a bearing (2) affixed to the louver, a hollow shaft (3) comprising a feather key (3*a*) and an anchor (3*b*), hollow shaft (3) positioned within bearing (2), a gear shaft (4) affixed to hollow shaft (3), a gear box (5) affixed to the adjustable shell (6) to which the gear shaft (4) is rotatably affixed, and a motor (12); wherein the one or more load bearing shells (7) and the one or more adjustable shells (6) are adjoined to one another; the feather key transmits rotation from the gear shaft (4) to bearing (2) and the louver (1); and, anchor (e.g., screw in FIG. 2) (3*b*) secures hollow shaft to gear shaft (4). This disclosure also relates to methods for using such systems. Other aspects of this disclosure are provided below and/or may be understood by those of ordinary skill in the art.

DETAILED DESCRIPTION OF THE INVENTION

This disclosure relates to louver drive systems and to methods for using such systems. In certain embodiments, this disclosure relates to louver drive systems comprising one or more load bearing shells (7); one or more adjustable shells (6) (also known as "floating bearings" as in part 10 in FIG. 1); one or more louvers (1); and one or more louver drive mechanisms (FIG. 2). In certain embodiments, the louver drive mechanism may comprise a bearing (2) affixed to the louver; a hollow shaft (3) (that may positioned within the bearing (2)) comprising a feather key (3*a*) and an anchor (3*b*) (e.g., a structural securing or anchoring component such as but not limited to a screw as shown in FIG. 2); a gear shaft (4) affixed to hollow shaft (3); a gear box (5) affixed to the adjustable shell (6) to which the gear shaft (4) is rotatably affixed; and a motor (12). In some embodiments, the load bearing shell (7) and the adjustable shell (6) are adjoined to one another (in some embodiments using, e.g., an adjustable internally threaded bolt (13)); the feather key transmits rotation from the gear shaft (4) to bearing (2) and the louver (1); and/or, the anchor (3*b*) secures the hollow shaft (3) to the gear shaft (4). In some embodiments, the gear shaft (4) is affixed to gear box (5) using a circlip (15). In some embodiments, the louver (1) may be comprised of metal, plastic or wood, but may be comprised of any suitable material. In some embodiments, the adjustable shell (6) may comprise multiple gear boxes (5) adjoined to one another through a rotatable shaft (11). In some embodiments, a gear transmission box (10) may be attached to motor (12) and provides rotation to the rotatable shaft (11). In some embodiments, the load bearing shell (7) and the adjustable shell (6) may be adjoined to one another by an adjustable internal threaded bolt. In some embodiments, such as those in which a system comprises multiple louvers, the components of the louver drive system may be arranged such that each louver may be operated in synch with one another, independently of one another, or independently of at least one other louver. Multiple louver drive systems may be used together for any suitable purpose such as, for example, covering a surface such as the ground or floor (see, e.g., FIG. 7). Other arrangements of the parts described here and in the drawings, i.e., other embodiments, are also contemplated, as would be understood by those of ordinary skill in the art.

In some embodiments, the louver drive systems may be used to rotate louvers suspended above a surface (e.g., the ground or floor) to particular angles. For instance, in some embodiments, the louver drive system may be used to hold louvers parallel to such a surface in, e.g., the "closed" position. In other embodiments, the louver drive system may be used to hold louvers at a position other than parallel to such a surface in, e.g., the "open" position (see, e.g., FIG. 6). In this way, the surface may be protected from a particular condition, such as a weather condition (e.g., one or more of sunlight, rain, temperature, wind speed and wind direction) and/or for appearance. For instance, the louver drive systems described herein may be used to rotate to an angle relative to the one or more adjustable shells (6) and/or parallel to a surface below the louver, the angle being selected from the group consisting of between zero and 180 degrees, or about any of zero, 15, 30, 45, 60, 90, 135, 180, 315 and 360 degrees. In some embodiments, the louver drive system may comprise a weather sensor capable of rotating one or more louvers of the system in response to one or more weather conditions. In such embodiments, the weather sensor may be capable of detecting a weather condition such as sunlight, rain, temperature, wind speed, wind direction, and combinations thereof. In some embodiments, the one or more weather conditions may be, for example, rain and a temperature of below 5° C. In some embodiments, the louver drive may comprise a manual control unit and/or an automatic control unit, either of which may be operably linked to a computer or device having computing ability (e.g., a cell phone, an iPhone®, or the like). Where a system comprises multiple louvers, each louver may be operated in synch with one another, independently of one another, or independently of at least one other louver. The louver drive systems described herein may have other uses as well, i.e., other embodiments, that are also contemplated herein, as would be understood by those of ordinary skill in the art.

In some embodiments, this disclosure relates to methods for using the louver drive systems described herein. For instance, in some embodiments, methods for covering a surface by positioning multiple louvers above a surface such as the ground or floor are provided. In some embodiments of such methods, the louvers shield a surface from one or more weather conditions (e.g., sunlight, rain, temperature, wind speed and/or wind direction). In some embodiments, the louvers methods provides for the rotation of one or more louvers from parallel to a surface to any desired angle therefrom. In some embodiments, the rotation may result from one or more weather conditions such as those described herein. In some embodiments, the methods provide for rotating the louvers are rotated from parallel to a surface to a desired angle therefrom at pre-set times. The methods for using the louver drive systems described herein are not limited to those described herein, and are also contemplated herein, as would be understood by those of ordinary skill in the art.

Figure 2:
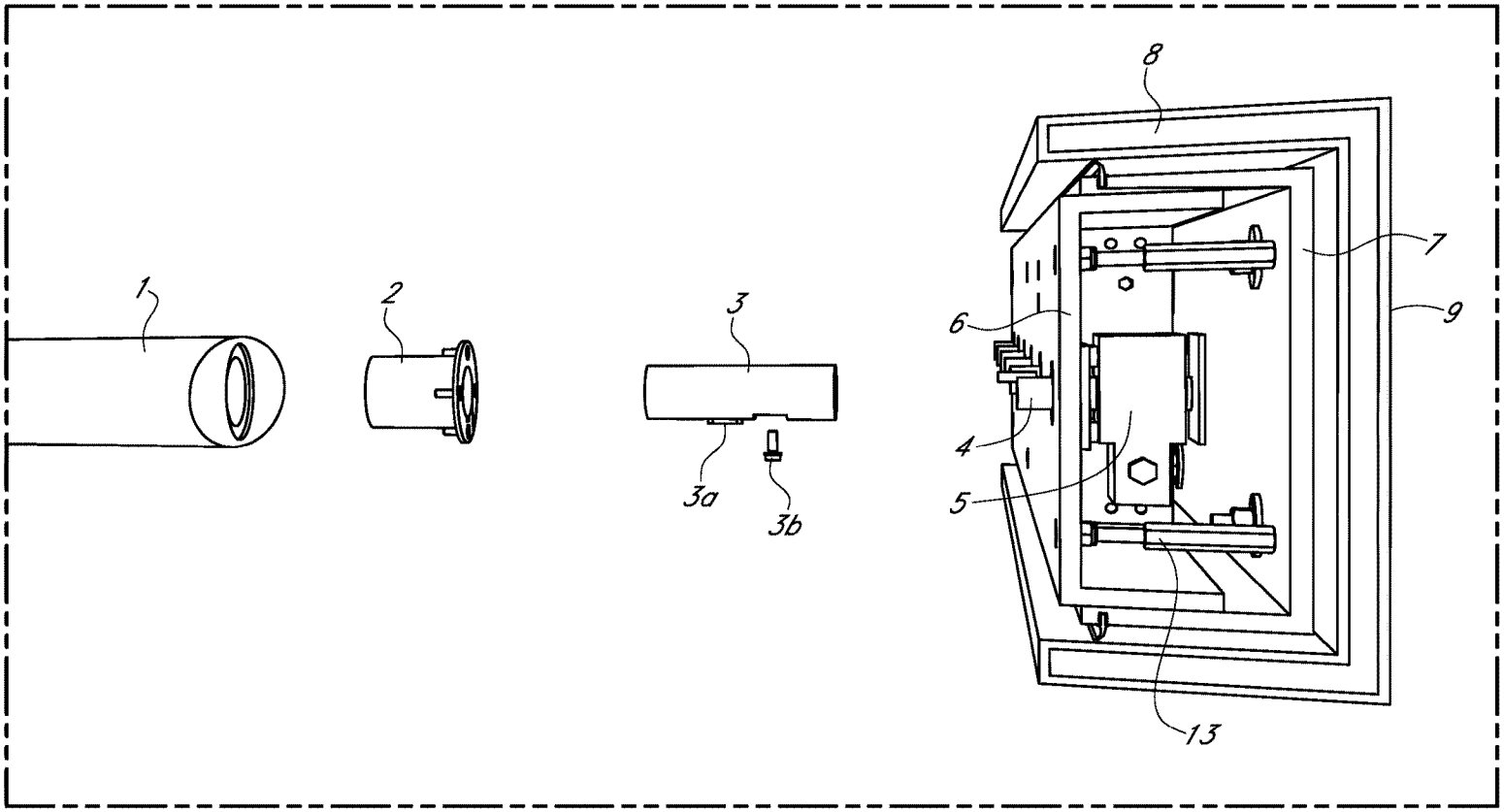
FIG. 2. Exemplary Louver Drive Mechanism.

FIG. 1 illustrates an exemplary louver drive system. As shown therein, the system comprises a louver (1) adjoined at each end to a one or more one or more adjustable shells (6) (also known as "floating bearings" as in part 10 in FIG. 1). At one end, louver (1) is adjoined to to an adjustable shells (6) that also comprises attached thereto one or more louver drive mechanisms (e.g., as in FIG. 2). Each adjustable shell (6) are also adjoined to a load bearing shell (7). In this embodiment, the adjustable shell (6) comprising the louver drive mechanism is adjoined to the load bearing shell (7) using an adjustable internally threaded bolt (14). In FIG. 1, each load bearing shell (7) is also affixed to a support structure (8).

Figure 3:
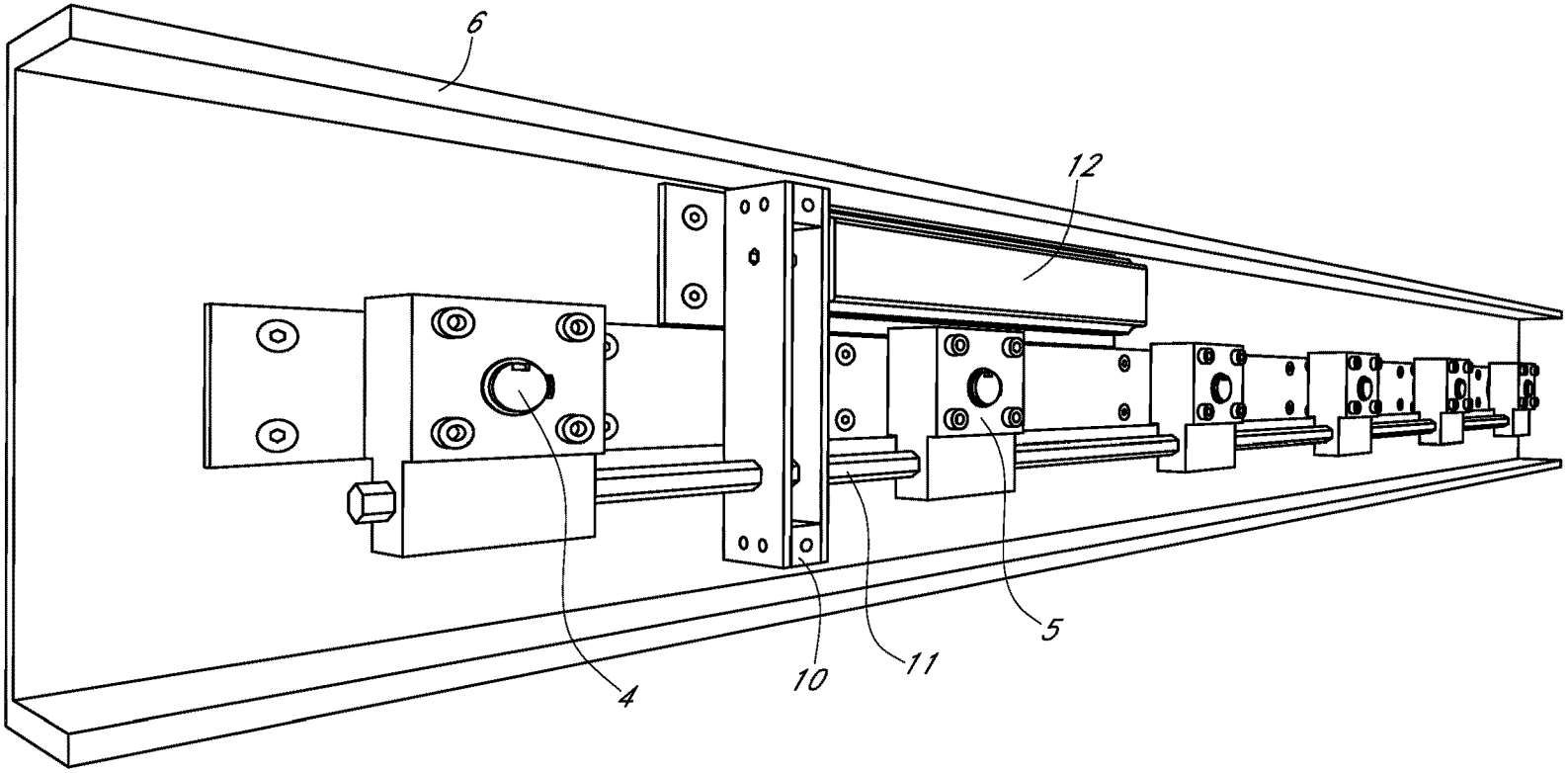
FIG. 3. Exemplary adjustable shell (6) with attached multiple gear shafts (4)/gear boxes (5) attached using shaft circlip (15), gear transmission box (10), rotating shaft (11), and motor (12).
Figure 4:
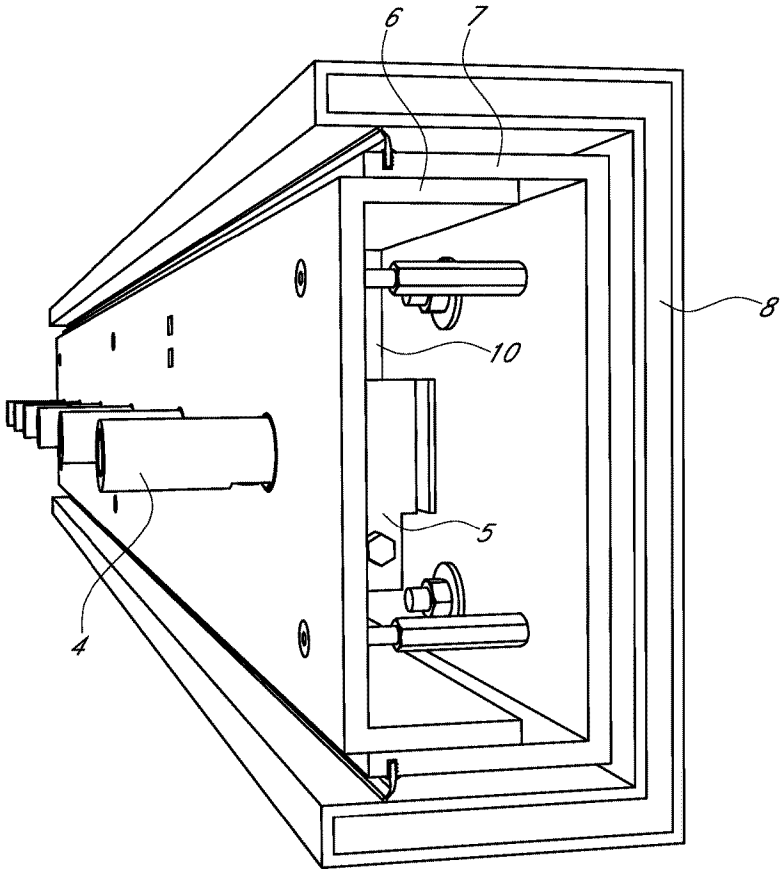
FIG. 4. Side view of exemplary Louver Drive Mechanism showing attachment of adjustable shell (6) and load bearing shell (7) using an adjustable internally threaded bolt (14). Louver Drive Mechanism is attached to a support structure (8). Gear transmission box (10), gear box (5) and gear shaft (4) are also shown.
Figure 5:
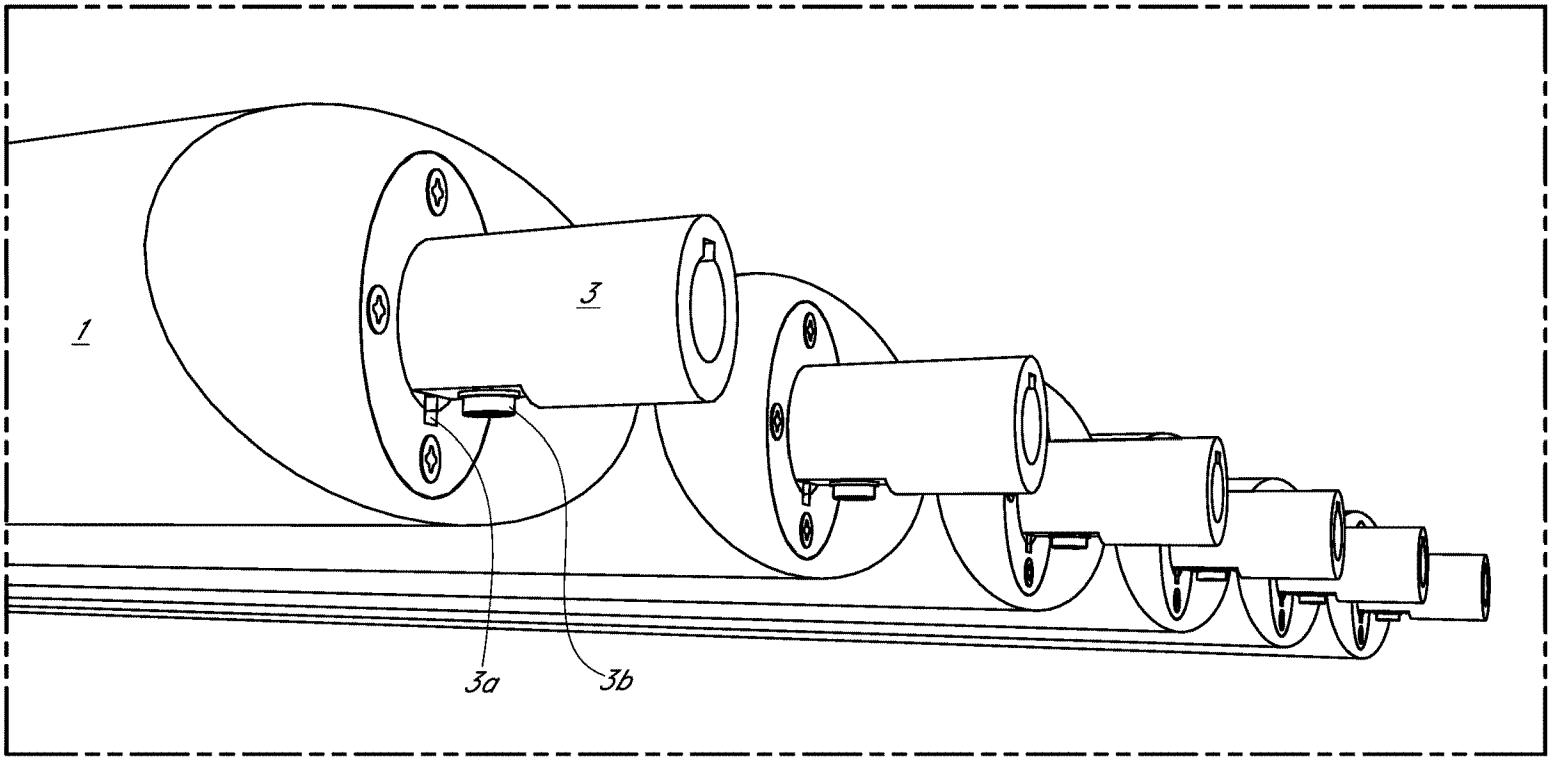
FIG. 5. Exemplary attachment of louver (1) to hollow shaft (3) comprising a feather key (3*a*) and an anchor (3*b*) and positioned within bearing (2).
Figure 6:
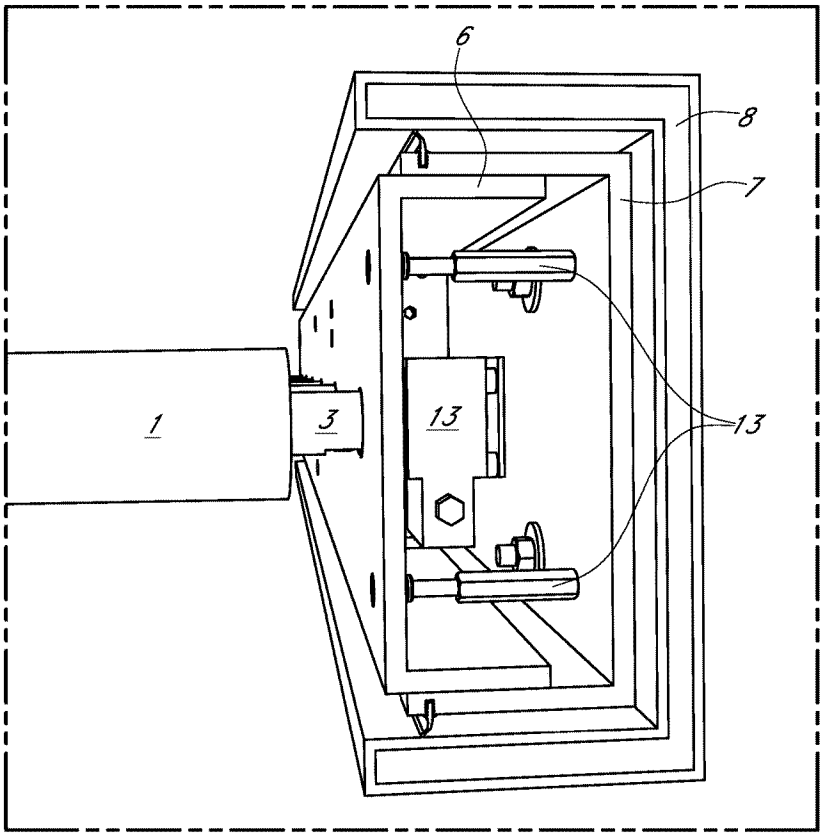
FIG. 6. Louver (1) attached to gear shaft through hollow shaft (3).
Figure 7:
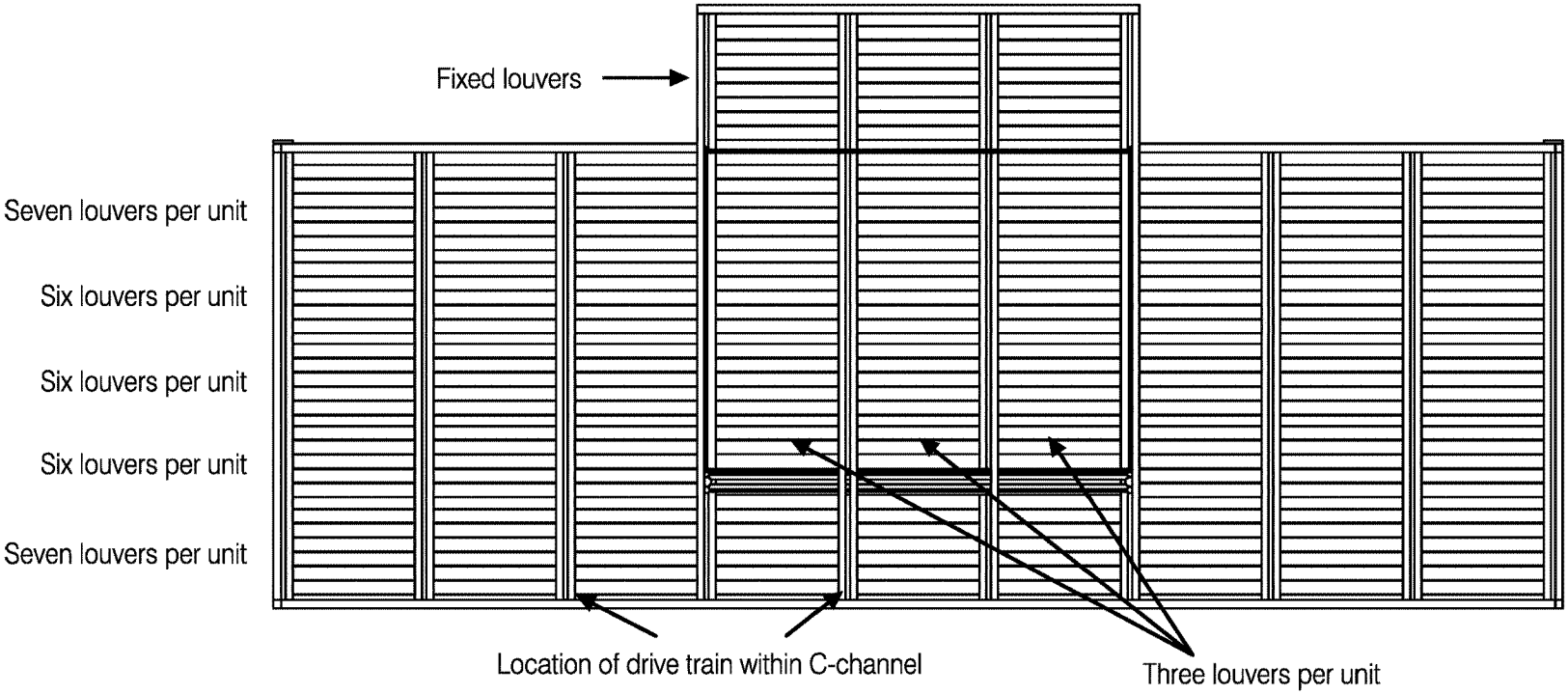
FIG. 7. Exemplary layout of 45 Louver Drive System units.

An exemplary louver drive mechanism is illustrated in FIG. 2. The louver drive mechanism illustrated therein comprises a bearing (2) affixed to the louver (1); a hollow shaft (3) positioned within bearing (2) and comprising a feather key (3*a*) and an anchor (3*b*); a gear shaft (4) affixed to hollow shaft (3); a gear box (5) affixed to the adjustable shell (6) to which the gear shaft (4) is rotatably affixed; and a motor (12 (FIG. 3)). The load bearing shell (7) and the adjustable shell (6) comprising the gear shaft (4) and gear box (5) are adjoined to one another using an adjustable internally threaded bolt (14). Feather key (3*a*) transmits rotation from the gear shaft (4) to the bearing (2) and thereby the louver (1) to which it is attached. The anchor (3*b*) secures the hollow shaft (3) to the gear shaft (4). The gear shaft (4) is affixed to gear box (5) using a circlip (15 (FIG. 3)). As shown in FIG. 3, one of the adjustable shells (6) may comprise multiple gear boxes (5) adjoined to one another through a rotatable shaft (11), a gear transmission box (10) and a motor (12) providing rotation to the rotatable shaft (11). As shown in FIG. 3, adjustable shell (6) may comprise multiple gear boxes (5) linked in series that operate synchronously with one another under control of motor (12) and gear transmission box (10). In some embodiments, multiple motors and gear transmission boxes may be used. FIGS. 4, 5, and 6 provide additional illustrations of the louver drive system and particular components and/or arrangements thereof. FIG. 7 illustrates an exemplary Louvre Drive System Exemplary layout in which 45 units are combined and utilized to cover a surface such as a patio. Each individual unit or group of units may operate independently of any other individual unit or group of units, or the units may operate together as single unit. FIG. 7 also illustrates exemplary combinations of units of three, six or seven louvers, as well as a number of fixed louvers.

This disclosure relates to louver drive systems and methods for using the same. In one embodiment, an exemplary louver drive system may comprise one or more load bearing shells (e.g., 7 in FIG. 1); one or more adjustable shells (e.g., 6 in FIG. 1); one or more louvers (e.g., 1 in FIG. 1); and one or more louver drive mechanisms (FIG. 2) which may each comprise a bearing (2) affixed to the louver, a hollow shaft (3) comprising a feather key (3*a*) and an anchor (3*b*), the hollow shaft (3) being positioned within bearing (2), a gear shaft (4) affixed to the hollow shaft (3), a gear box (5) affixed to the adjustable shell (6) to which the gear shaft (4) is rotatably affixed, and a motor (12); wherein the one or more load bearing shells (7) and the one or more adjustable shells (6) are adjoined to one another; the feather key transmits rotation from the gear shaft (4) to bearing (2) and the louver (1); and, anchor (e.g., screw in FIG. 2) (3*b*) secures hollow shaft to gear shaft (4). In some embodiments, the system may comprise multiple adjustable shells (6) wherein at least one of the adjustable shells (6) comprises the louver drive mechanism attached thereto. In some embodiments, the system may comprises gear shaft (4) is affixed to gear box (5). In some embodiments, the gear shaft (4) may be affixed to the gear box (5) using a circlip (15). In some embodiments, the louver (1) may comprise metal, plastic and/or wood. In some embodiments, the adjustable shell (6) may comprise multiple gear boxes (5) adjoined to one another through a rotatable shaft (11). In some embodiments, the gear transmission box (10) attached to motor (12) and providing rotation to the rotatable shaft (11). In some embodiments, the load bearing shell (7) and the adjustable shell (6) may be adjoined to one another by an adjustable internal threaded bolt. In some embodiments, the louver may rotate to an angle relative to parallel to the one or more adjustable shells (6), the angle being selected from the group consisting of between zero and 360 degrees, or about any of zero, 15, 30, 45, 60, 90, 135, 180, 315 and 360 degrees. In some embodiments, the system may comprise a weather sensor capable of rotating one or more louvers of the system in response to one or more weather conditions such as one or more weather conditions is selected from the group consisting of sunlight, rain, temperature, wind speed and/or wind direction (e.g., the one or more weather conditions is rain and a temperature of below 5° C.). In some embodiments, the system may comprise a manual control unit and/or an automatic control unit that may be operably linked to a computer (e.g., a notebook computer or an iPhone). Other embodiments are also contemplated as will be understood by those of ordinary skill in the art.

In some embodiments, methods for using the systems described herein are also provided. In some embodiments, the methods comprise covering a surface (e.g., a patio) with multiple louvers positioned above the surface. In some embodiments, the louvers shield the surface from one or more weather conditions such as, for instance, sunlight, rain, temperature, wind speed and/or wind direction. In some embodiments, the louvers may be rotated from horizontal to a surface to a desired angle therefrom. In some embodiments, the louvers may be rotated from horizontal to a surface to a desired angle therefrom at pre-set times. Other embodiments are also contemplated as will be understood by those of ordinary skill in the art.

The terms "about", "approximately", and the like, when preceding a list of numerical values or range, refer to each individual value in the list or range independently as if each individual value in the list or range was immediately preceded by that term. The terms mean that the values to which the same refer are exactly, close to, or similar thereto. Optional or optionally means that the subsequently described event or circumstance can or cannot occur, and that the description includes instances where the event or circumstance occurs and instances where it does not. Ranges may be expressed herein as from about one particular value, and/or to about another particular value. When such a range is expressed, another aspect includes from the one particular value and/or to the other particular value. For example, a ranges of 90-100% is meant to include the range per se as well as each independent value within the range as if each value was individually listed (e.g., any of 90, 91, 92, 93, 94, 95, 96, 97, 98, 99, or 100%). It will be further understood that the endpoints of each of the ranges are significant both in relation to the other endpoint, and independently of the other endpoint. Similarly, when values are expressed as approximations, such as by use of the antecedent "about" or "approximately", it will be understood that the particular value forms another aspect of the disclosure and, in some embodiments, may indicate a value of +/−10% of the listed value. The term "combined" or "in combination" or "in conjunction" may refer to a physical combination of elements or components. The term "on" and "upon", unless otherwise indicated, means "directly on or directly connected to the other element" (e.g., two parts of the systems described herein). The term "adjacent to" may refer to a direct or an indirect connection between two elements such as parts of the systems described herein. One element may be "adjoined to" another element directly or indirectly.

All references cited within this disclosure are hereby incorporated by reference in their entirety. Certain embodiments are further described in the following examples. These embodiments are provided as examples only and are not intended to limit the scope of the claims in any way. While certain embodiments have been described in terms of the preferred embodiments, it is understood that variations and modifications will occur to those skilled in the art. Therefore, it is intended that the appended claims cover all such equivalent variations that come within the scope of the following claims.

What is claimed is:

1. A louver drive system comprising:
a load bearing shell;
an adjustable shell;
one or more louvers; and
a louver drive mechanism comprising:
a bearing affixed to the louver,
a hollow shaft comprising a feather key and an anchor, the hollow shaft being positioned within the bearing,
a gear shaft affixed to the hollow shaft, and rotatably attached to the adjustable shell,
a gear box affixed to the adjustable shell, and
a motor;
wherein:
the load bearing shell and the adjustable shell are adjoined to one another;
the feather key transmits rotation from the gear shaft to the bearing and the louver; and,
anchor secures the hollow shaft to the gear shaft.

2. The system of claim 1 comprising multiple adjustable shells wherein at least one of said adjustable shells comprises the louver drive mechanism attached thereto.

3. The system of claim 1 wherein the gear shaft is affixed to the gear box using a circlip.

4. The system of claim 1 wherein the louver is comprises metal, plastic or wood.

5. The system of claim 1 wherein the adjustable shell comprises multiple gear boxes adjoined to one another through a rotatable shaft.

6. The system of claim 1 wherein a gear transmission box is attached to the motor.

7. The system of claim 1 wherein the load bearing shell and the adjustable shell are adjoined to one another by an adjustable internal threaded bolt.

8. The system of claim 1 wherein the one or more louvers may rotate to an angle relative to the adjustable shells at an angle selected from the group consisting of between approximately zero and 360 degrees.

9. The system of claim 1 further comprising a weather sensor capable of rotating said one or more louvers of the system in response to one or more weather conditions.

10. The system of claim 9 wherein the one or more weather conditions is selected from the group consisting of sunlight, rain, temperature, wind speed and wind direction.

11. The system of claim 10 wherein the one or more weather conditions is rain and a temperature of below 5° C.

12. The system of claim 1 further comprising a manual control unit or an automatic control unit.

13. The system of claim 12 wherein the manual or automatic control unit are operably linked to a computer or device having computing ability.

14. A method for covering above a surface using a system of claim 1 utilizing said one or more louvers.

15. The method of claim 14 wherein the one or more louvers shield the surface from one or more weather conditions.

16. The method of claim 15 wherein the one or more weather conditions is selected from the group consisting of sunlight, rain, temperature, wind speed and wind direction.

17. The method of claim 14 wherein the one or more louvers are rotated from horizontal to a desired angle relative to the surface.

18. The method of claim 17 wherein the one or more louvers are rotated from horizontal to a desired angle relative to the surface at pre-set times.

19. The system of claim 1 comprising said one or more louvers arranged such that each louver opreates in synch with at least one other louver, or operates independently of at least one other louver.

20. The system of claim 19 wherein the comprising multiple louvers arranged in groups and each group of louvers operates as a single unit.

21. The system of claim 1 wherein the adjustable shell comprises multiple louver drive mechanisms attached thereto.

22. The system of claim 1 wherein the the load bearing shell is affixed to a support structure.

* * * * *